US006579130B2

(12) United States Patent
Miwa

(10) Patent No.: US 6,579,130 B2
(45) Date of Patent: Jun. 17, 2003

(54) COUPLING CONNECTOR

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/814,791

(22) Filed: Mar. 23, 2001

(65) Prior Publication Data

US 2001/0024900 A1 Sep. 27, 2001

(30) Foreign Application Priority Data

Mar. 23, 2000 (JP) ..... 2000-082453

(51) Int. Cl.[7] ..... H01R 15/00
(52) U.S. Cl. ..... 439/732; 439/281
(58) Field of Search ..... 439/281, 271, 439/278, 732, 660, 699.1, 598

(56) References Cited

U.S. PATENT DOCUMENTS 4,061,406 A * 12/1977 Kunkle ..... 439/732
5,173,062 A * 12/1992 Uchida ..... 439/732
5,810,615 A 9/1998 Ohta ..... 439/313
5,969,648 A * 10/1999 Hayashi ..... 439/732
6,120,331 A * 9/2000 Lin ..... 439/598

OTHER PUBLICATIONS

Search Report for Application No. GB 0107396.4, United Kingdom Patent Office, Jul. 18, 2001.

* cited by examiner

*Primary Examiner*—Hien Vu
(74) *Attorney, Agent, or Firm*—Finnegan, Henderson, Farabow, Garrett & Dunner, L.L.P.

(57) ABSTRACT

A female connector housing (4) has a terminal accommodation chamber (5) configured for accommodating therein a pair of male terminals (6) and provided with a leakage prevention wall (7) as a partition for dividing the terminal accommodation chamber (5) into a pair of divided terminal accommodation chambers (8) neighboring to each other for individual accommodation of the male terminals (6). A male connector housing (10) has a pair of neighboring terminal cavity block portions (11) configured for accommodation of female terminals, to be individually inserted into the divided terminal accommodation chambers (8), and to define therebetween a mating recess (13) for the leakage prevention wall (7) to be inserted therein. When the male connector housing (10) is fitted into the female connector housing (4), the leakage prevention wall (7) tight fits in the mating recess (13), thereby preventing water invasion.

5 Claims, 6 Drawing Sheets

COUPLING CONNECTOR

BACKGROUND OF THE INVENTION

1. Field of the Invention

The present invention relates to a coupling connector with first and second connectors coupled, and more particularly, to an art of preventing the generation of leakage current between terminals disposed in terminal accommodation chambers.

2. Description of the Related Art

For such connectors as having a plurality of terminals accommodated and disposed in terminal accommodation chambers, there has been an invention of preventing the generation of leakage current between the terminals accommodated in the terminal accommodation chambers. FIG. 11 shows an example of such an invention having been proposed in which a leakage prevention wall 103 is provided in a connector housing 102 to insulate terminal accommodation chambers 101 from each other. In this connector, the leakage prevention wall 103 lengthens the surface-connected distance between the adjacent terminals, thereby to prevent leakage current from being generated between the adjacent terminals.

The conventional leakage prevention wall 103, however, only prevents the generation of leakage current by lengthening the surface-connected distance between the adjacent terminals, and cannot prevent the generation of leakage current caused by water invading into the connector housing 102. As a means for preventing the water-causing generation of leakage current in such a structure, it can be conceived to fit a packing member made of rubber or the like onto the entire internal periphery of the terminal accommodation chambers 101, 101 to provide a water-tight structure between the engaging surfaces with the mating connector. However, the fitting of the packing member onto the entire internal periphery of the terminal accommodation chambers 101, 101 makes the connector larger.

SUMMARY OF THE INVENTION

The present invention is made with such points in view. It therefore is an object of the present invention to provide a coupling connector in compact size which can prevent the generation of leakage current including one caused by water invading into its connector housing.

To achieve the object, according to a first aspect of the invention, there is provided a coupling connector comprising a first connector comprising a first connector housing, a terminal accommodation chamber provided in the first connector housing for disposing a plurality of terminals therein, and a leakage prevention wall for dividing the terminal accommodation chamber into divided terminal chambers for the respective terminals, the leakage prevention wall constituting a bulkhead between the divided terminal chambers adjacent to each other, and a second connector comprising a second connector housing, a plurality of terminal cavity block portions provided in the second connector housing for accommodating terminals inside, the terminal cavity block portions being arranged to be individually inserted into the divided terminal chambers, and a mating recess provided between the terminal cavity block portions adjacent to each other for the leakage prevention wall to be inserted therein, and a water invasion preventing mechanism provided between the leakage prevention wall and the mating recess for preventing water from entering therebetween when the first connector housing of the first connector and the second connector housing of the second connector are mated with other.

Therefore in the coupling state where each terminal cavity block portion of the second connector housing is inserted into each divided terminal chamber of the first connector housing, leakage current may pass between the adjacent terminals along the leakage prevention wall and the surface of the mating recess. However, the passage along the surfaces is longer and the water invasion preventing mechanism prevents water from entering between the leakage prevention wall and the mating recess, which can prevent the generation of leakage current including one caused by water entering into the connector housings, and further can provide a compact coupling connector.

According to a second aspect of the invention, the water invasion preventing mechanism is sized to bring the leakage prevention wall into intimate contact with the mating recess at at least one part in their width direction.

Therefore the water invasion preventing mechanism can be realized by making the leakage prevention wall and the mating recess have their respective widths meeting prescribed conditions. This provides easy construction of the water invasion preventing mechanism and easy manufacturing thereof.

According to a third aspect of the invention, the leakage prevention wall has a proximal part and a frontward part each set smaller in width than the corresponding parts of the mating recess at the time of the mating, thereby to bring the leakage prevention wall into intimate contact with the mating recess at the two parts.

Therefore the leakage prevention wall is brought into intimate contact with the mating recess at the two parts, which provides double prevention for water ingress, resulting in ensured water ingress prevention.

According to a fourth aspect of the invention, the leakage prevention wall has a part between the proximal part and the frontward part, the part being set smaller in width than an insertion opening of the mating recess.

Therefore the part between the proximal part and the frontward part of the leakage prevention wall can pass through the insertion opening of the mating recess with clearance. This weakens insertion resistance caused by the mating of the female connector housing and the male connector housing, contributing to smooth mating of the connectors.

According to a fifth aspect of the invention, a coupling connector as set forth in conjunction with the first aspect further comprises a locking projection provided at the leakage prevention wall, and a locking engagement part provided at the mating recess, wherein the locking projection is engaged with the locking engagement part at the time of mating of the connectors.

Therefore the leakage prevention wall and the mating recess are utilized to add the locking of the female connector housing and the male connector housing, which simplifies the structure of the connector. Further, this provides precise relative positioning of the leakage prevention wall and the mating recess, ensuring the intimate contact state.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
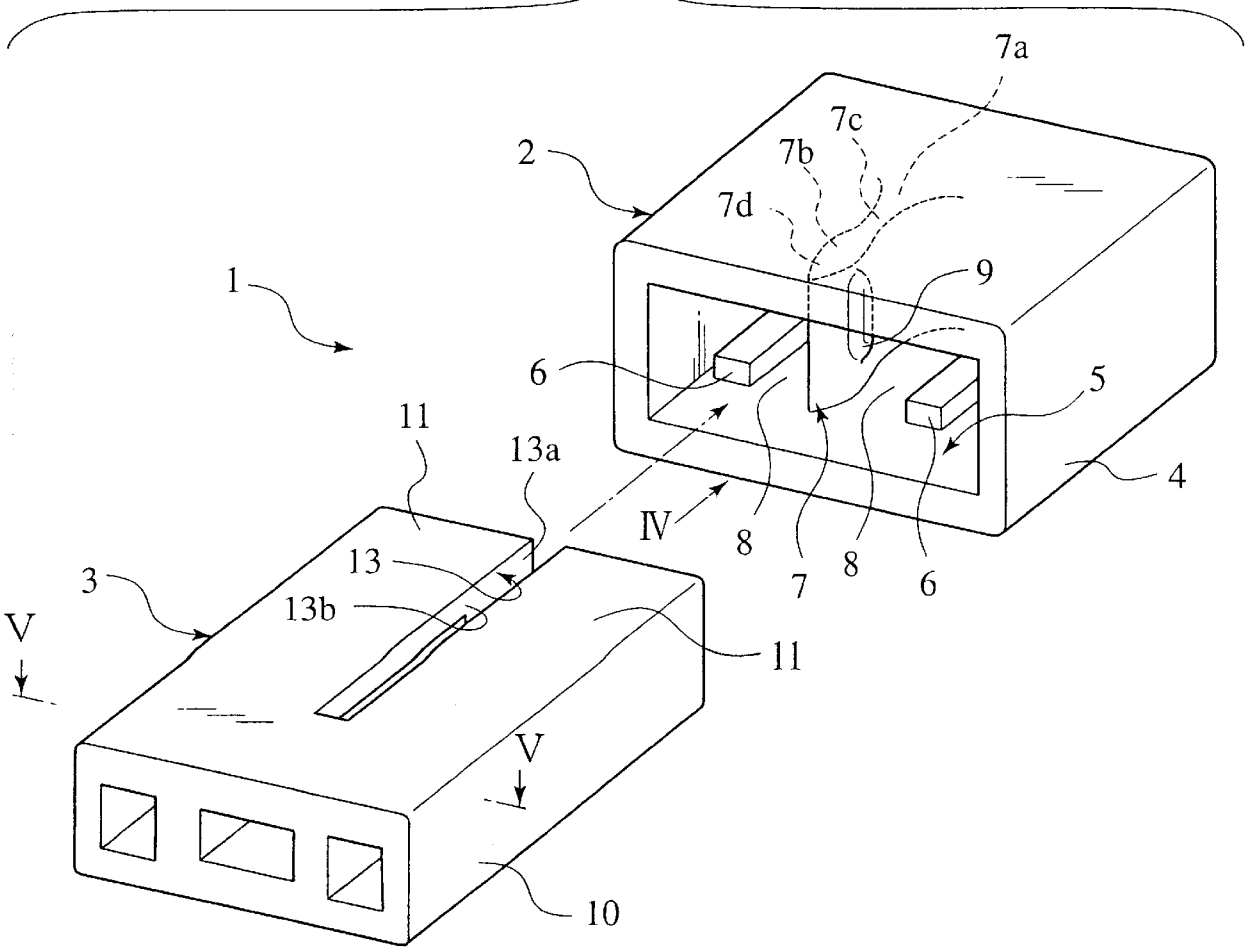
FIG. 1 is an exploded perspective view of a coupling connector according to an embodiment of the invention.

There will be detailed below the preferred embodiments of the present invention with reference to the accompanying drawings. Like members are designated by like reference characters.

Figure 2:
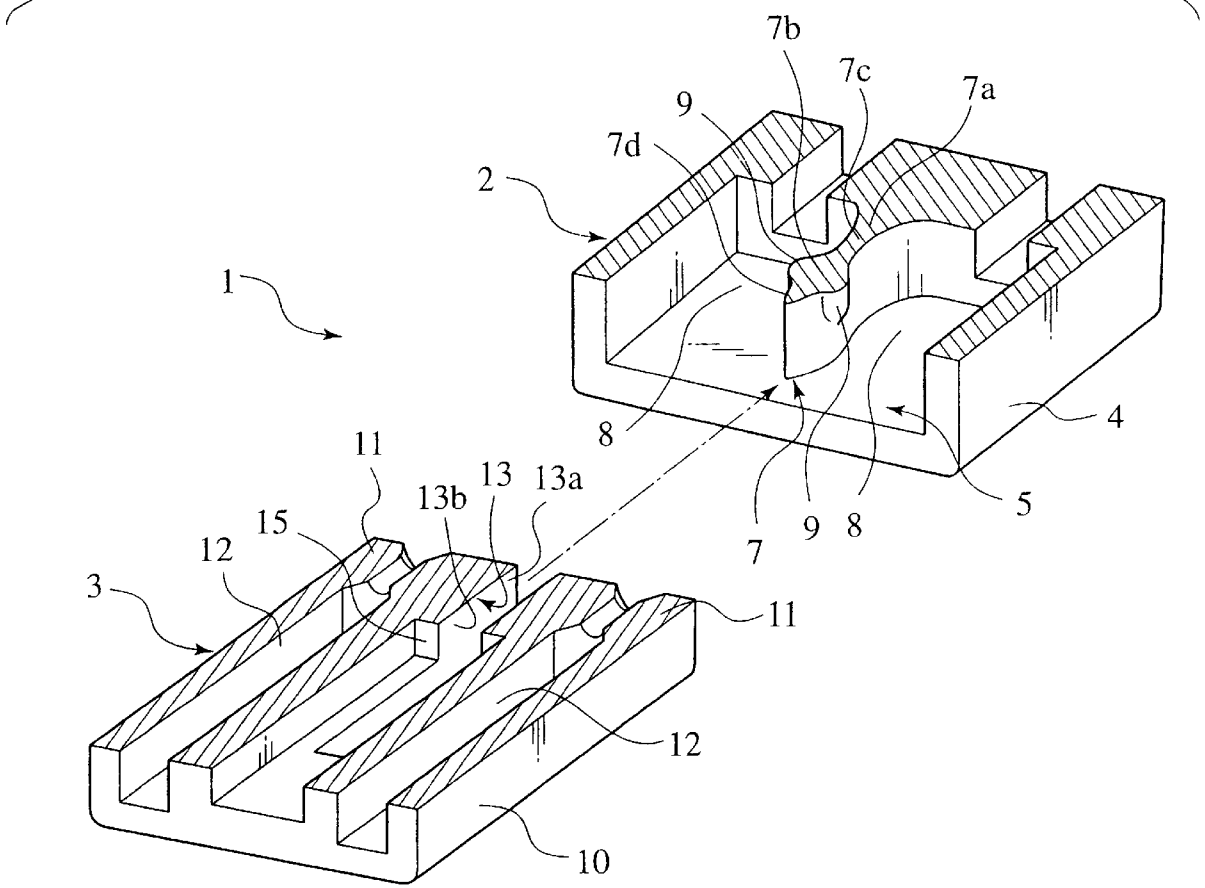
FIG. 2 is an exploded perspective sectional view of the coupling connector of FIG. 1.
Figure 3:
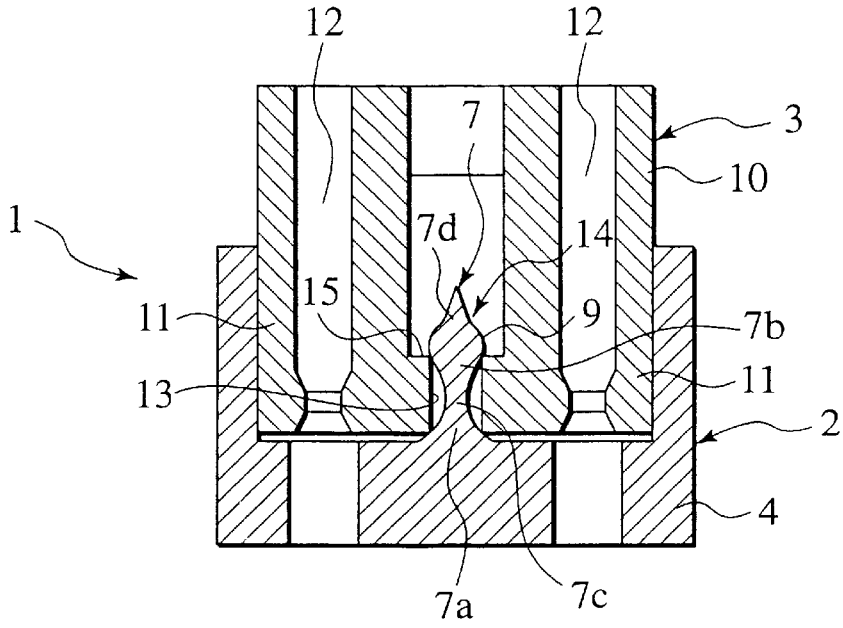
FIG. 3 is a cross sectional view of the coupling connector of FIG. 1.
Figure 4:
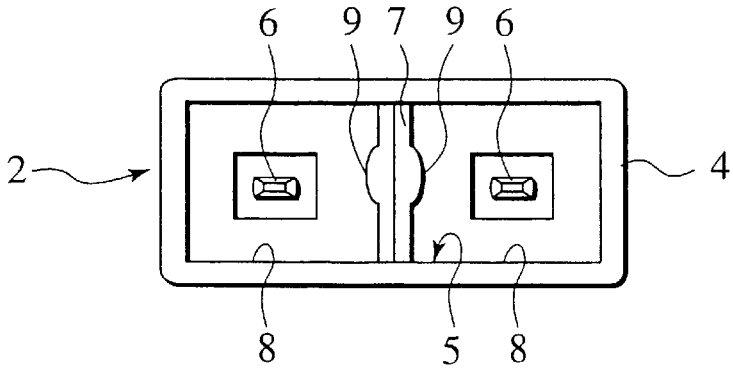
FIG. 4 is a front view along arrow IV of a first connector of the coupling connector of FIG. 1.
Figure 5:
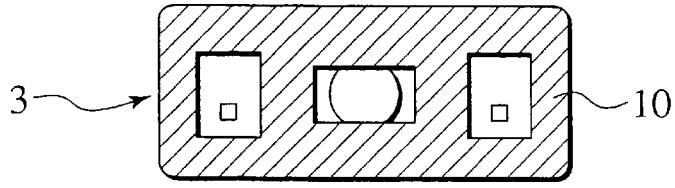
FIG. 5 is a sectional view along line V—V of FIG. 1.
Figure 6:
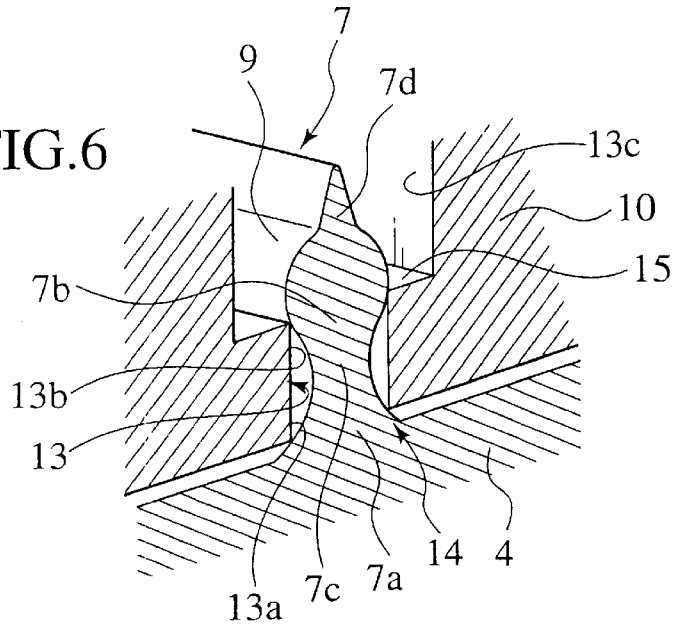
FIG. 6 is a perspective sectional view of a mating recess and a leakage prevention wall fitted therein of the coupling connector of FIG. 1.
Figure 7:
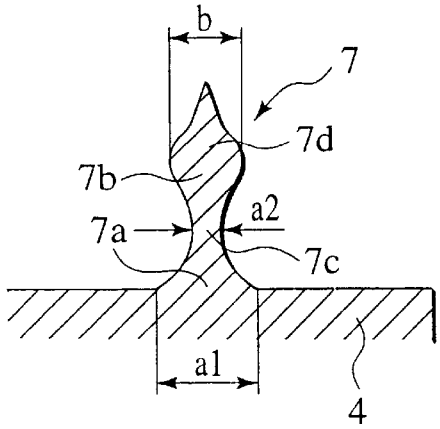
FIG. 7 is a dimensioned sectional view of the leakage prevention wall of FIG. 6.
Figure 8:
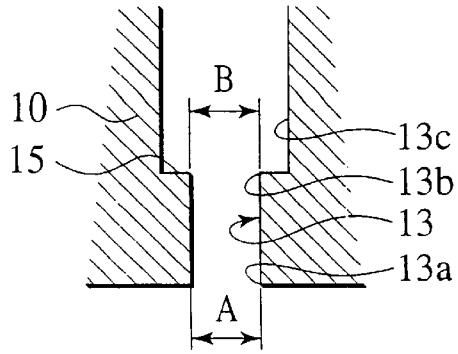
FIG. 8 is a dimensioned sectional view of the mating recess of FIG. 6.

FIG. 1 to FIG. 8 show a connector coupling 1 as a set of first and second connectors 2 and 3 to be coupled with each other according to an embodiment of the invention, in which FIG. 1 is a perspective view of the first and second connectors 2 and 3 before coupling, FIG. 2, a perspective view, in longitudinal section, of the first and second connectors 2 and 3, FIG. 3, a cross sectional view of the first and second connectors 2 and 3 after coupling, FIG. 4, a view of the first connector 2 along arrow IV of FIG. 1, FIG. 5, a section of the second connector 3 along line V—V of FIG. 1, FIG. 6, a perspective sectional view of a leakage prevention wall 7 of the first connector 2 and a mating recess 13 of, the second connector 3 fitted thereon, FIG. 7, a dimensioned sectional view of the leakage prevention wall 7, and FIG. 8, a dimensioned sectional view of the mating recess 13.

As shown in FIG. 1 to FIG. 5, the connector coupling 1 is constituted with a first connector 2 and a second connector 3 to be fitted thereto for coupling. The first connector 2 has a female connector housing 4 as a first connector housing, which is formed with a terminal accommodation chamber 5 wholly open at one end thereof (i.e. at this or front end in FIG. 1, where it is rectangular mouthed). The terminal accommodation chamber 5 has therein a pair of longitudinally extending male terminals 6 disposed in transversely shifted positions.

The terminal accommodation chamber 5 is divided or partitioned by a longitudinally and vertically extending spade-shaped central leakage prevention wall 7 into a pair of left and right divided terminal accommodation chambers 8 in which the male terminals 6 are individually accommodated. The leakage prevention wall 7 continuously joins associated housing walls, so that left and right vertical sides of the leakage prevention wall 7 are connected at their rear ends to a rear wall of the terminal accommodation chamber 5 (or more specifically, respective rear walls of the left and right divided terminal accommodation chambers 8), and at their top and bottom edges to top and bottom walls of the terminal accommodation chamber 5 (or of the chambers 8). A bulged distal part (or a front part) 7*d* of the leakage prevention wall 7 has a pair of locking projections 9 formed arcwise on both vertical sides thereof.

The second connector 3 has a male connector housing 10 as a second connector housing, which is formed with a pair of left and right terminal cavity block portions 11 to be individually fitted in the left and right divided terminal chambers 8 of the first connector housing 4. Each terminal cavity block portion 11 has therein a terminal accommodation chamber 12 for accommodating electrical connection between a female terminal (not shown) and a corresponding one of the male terminals 6. Between the left and right terminal block portions 11 is defined a mating recess 13, which is open at the top and bottom sides as well as at a mating side (a rear side in FIG. 1) thereof where the leakage prevention wall 7 is to be inserted. The paired terminal cavity block portions 11 are flexible to elastically deform in both mutually approaching and spacing directions.

Between the leakage prevention wall 7 and the mating recess 13 is provided a water invasion preventing mechanism 14 as a means for preventing water invasion therebetween. As detailed in FIG. 6 to FIG. 8, the water invasion preventing mechanism 14 is configured by combination of two different thicknesses of the leakage prevention wall 7 at a proximal end 7*a* and a distal location 7*b* just below the locking projections 9, and smaller widths at corresponding two locations 13*a*, 13*b* of the mating recess 13 where the proximal end 7*a* and the distal location 7*b* are to be fitted.

In other words, as shown in FIG. 7, letting "a1" be the thickness at the proximal end 7*a* of the leakage prevention wall 7, "b" be the thickness at the distal location 7*b* of the proximal end 7*a* of the leakage prevention wall 7 below the locking projections 9, and "A" and "B" be the widths at the location 13*a* standing as an entrance or proximal edge with respect to an insertion of the leakage prevention wall 7 and at the location 13*b* standing as a distal or in-depth edge with respect to the insertion, respectively, they are set such that a1>A and b>B. Further, at a location 7*c* between the proximal end 7*a* and the distal location 7*b* below the locking projections 9 in the leakage prevention wall 7, its thickness "a2" is set smaller than the width A at the location 13*a* as an insertion entrance of the mating recess 13, that is, a1>A>a2.

The mating recess 13 has a wide-spread part 13*c* at a deeper location of the in-depth edge 13*b*, and a pair of steps formed as boundaries each constituting a locking engagement part 15 between the in-depth edge 13*b* and the wide-spread part 13*c*. The locking engagement part 15 is configured for engagement with a corresponding locking projection 9 of the leakage prevention wall 7.

There will be described how the first and second connectors 2 and 3 are connected to each other. As shown in FIG. 1 and FIG. 2, the female connector housing 4 of the first connector 2 is positioned to the male connector housing 10 of the second connector 3, so that their terminal insertion sides oppose each other. Then, the cavity block portions 11 of the male connector housing 10 are individually inserted into the divided terminal chambers 8 of the female connector housing 4. As the insertion progresses, the male terminal 6 in each divided terminal chamber 8 of the female connector housing 4 is brought into contact with a female terminal (not shown) in a corresponding cavity block portion 11 of the male connector housing 10, and finally an insertion leading end face of each cavity block portion 11 of the male connector housing 10 is brought into abutment with a rear end wall of a corresponding divided terminal chamber 8 of the female connector housing 4. In this state of insertion, each male terminal 6 is brought into full contact with a mating terminal (not shown).

Along with insertion of the terminal cavity block portions 11 of the male connector housing 10 into the divided terminal chambers 8 of the female connector housing 4, the leakage prevention wall 7 of the female connector housing 4 is inserted into the mating recess 13 of the male connector housing 10. More specifically, when the distal location 7*b* of the leakage prevention wall 7 is inserted at the location 13*a* of insertion entrance of the mating recess 13, the distal location 7*b* of the leakage prevention wall 7 is compressed and elastically deforms, while the paired terminal cavity block portions 11 which receive reaction forces of the elastic compression are thereby forced to elastically deform in mutually spacing directions, so that the mating recess 13 has an increased width, allowing insertion of the leakage prevention wall 7.

As the distal location 7*b* of the leakage prevention wall 7 having slipped out of the in-depth edge 13*b* of the mating recess 13 arrives at the wide-spread part 13*c*, the distal location 7*b* of the of the leakage prevention wall 7 elastically deforms to have a restored form, while the paired terminal cavity block portions 11, now free from the reaction of elastic compression of the leakage prevention wall 7, elastically deform to return in mutually approaching directions for restoration, causing the mating recess 13 to have a restored width. Then, at the completion of insertion, as shown in FIG. 3 and FIG. 6, the locking projections 9 of the leakage prevention wall 7 engage with the locking engagement parts 15 of the mating recess 13, whereby the male and female connector housings 4, 10 are mutually locked.

Because the widths at the proximal and in-depth edges 13*a*, 13*b* of the mating recess 13 are set smaller than the thicknesses of the two locations mating thereto, i.e. at the proximal end 7*a* and at the distal location 7*b* of the leakage prevention wall 7 adjacent the locking projections 9, there are achieved tight-fitted states at the two locations between the leakage prevention wall 7 and the mating recess 13.

In this embodiment, the first connector 2 has a surface-connected distance along the leakage prevention wall 7 between the paired male terminals 6, and the second connector 3 has a surface-connected distance along the separate terminal cavity block portions 11 between the paired female terminals (not shown), whereby occurrences of leak currents are individually prevented.

Further, in a coupled state between the first and second connectors 2, 3 in which the terminal cavity block portions 11 of the male connector housing 10 are inserted into the divided terminal accommodation chambers 8 of the female connector housing 4, the neighboring male terminals 6 have a number of leakage paths, such as along surfaces of the leakage prevention wall 7 and the mating recess 13. That is, in addition to the water invasion preventing means 14 between the leakage prevention wall 7 and the mating recess 13, the leakage paths have relatively long surface-connected distance.

It is therefore possible to prevent occurrences of leakage currents including those which otherwise might have been caused by water invasion into the male and female connector housings 4 and 10. Unlike a conventional case, no packing elements were applied over the leakage prevention wall 7 nor inside the mating recess 13. Simply by provision of the water invasion preventing means 14 between the leakage prevention wall 7 and the mating recess 13, occurrences of leakage currents caused by water invasion are prevented, permitting the connector 1 to be compact and kept from increase in size.

The water invasion preventing means 14 constitutes tight-fit at two contact locations between the leakage prevention wall 7 and the mating recess 13 by dimensioning their thickness and width as described, with a simplified structure and facilitated fabrication.

In this embodiment in which widths at the proximal and in-depth edges 13*a*, 13*b* of a mating recess 13 are set smaller than the thicknesses of two locations mating thereto, i.e. at the proximal end 7*a* and at the distal location 7*b* of the leakage prevention wall 7 adjacent locking projections 9, water invasion can be redundantly prevented with an ensured effect. It is noted that the contact locations having such a tight-fit between the leakage prevention wall 7 and the mating recess 13 may well be only one or more than two.

Moreover, since the thickness at the location 7*c* between the proximal end 7*a* and the distal location 7*b* is set smaller than the width at the proximal location 13*a* of the mating recess 13, it allows the location 7*c* between the proximal end 7*a* and the distal location 7*b* to pass through the proximal location 13*a* with a commensurate reduction of an insertion resistance when mating the male connector housing 10 with the female connector housing 4, permitting a smooth insertion.

Further, for an effective locking engagement between the female connector housing 4 and the male connector housing 10, there are provided the locking projections 9 on the leakage prevention wall 7 and the locking engagement parts 15 in the mating recess 13 configured to engage the locking projections 9 therewith. In other words, there is provided a locking means between the female connector housing 4 and the male connector housing 10 by making use of the leakage prevention wall 7 and the mating recess 13, permitting a simplified structure. A correct positioning between the leakage prevention wall 7 and the mating recess 13 ensures a tight-fitted state.

Figure 9:
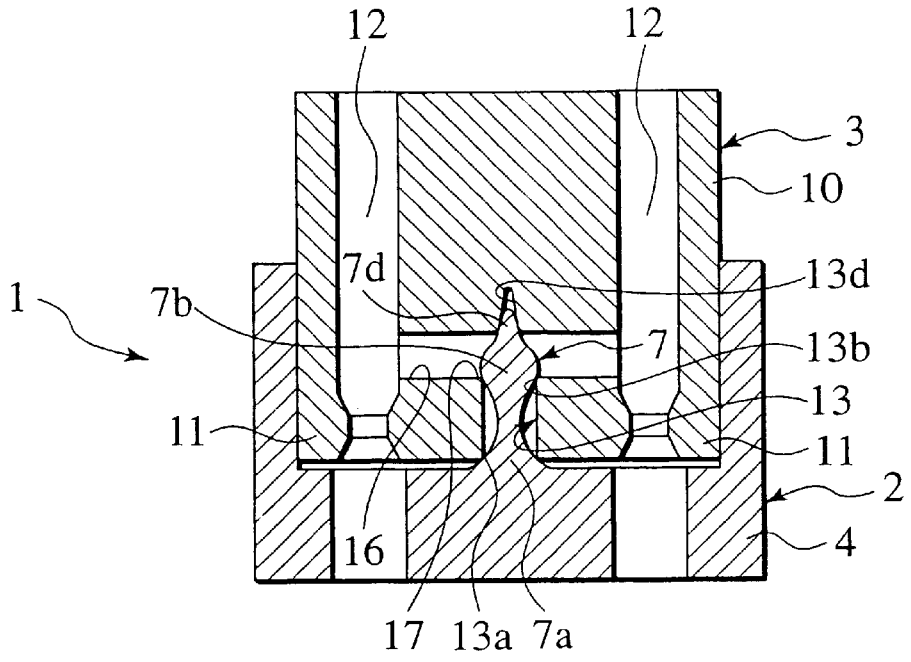
FIG. 9 is a sectional view of a coupling connector according to another embodiment of the invention.
Figure 10:
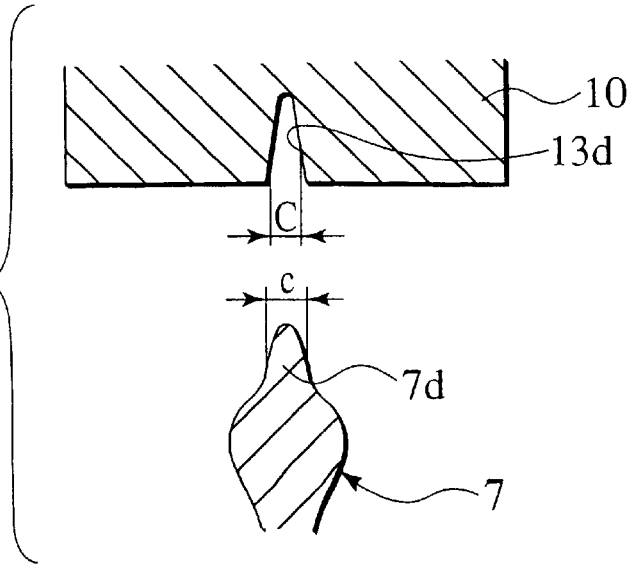
FIG. 10 is an exploded sectional view of a mating recess and a locking projection to be tight-fitted thereto of the coupling connector of FIG. 9.
Figure 11:
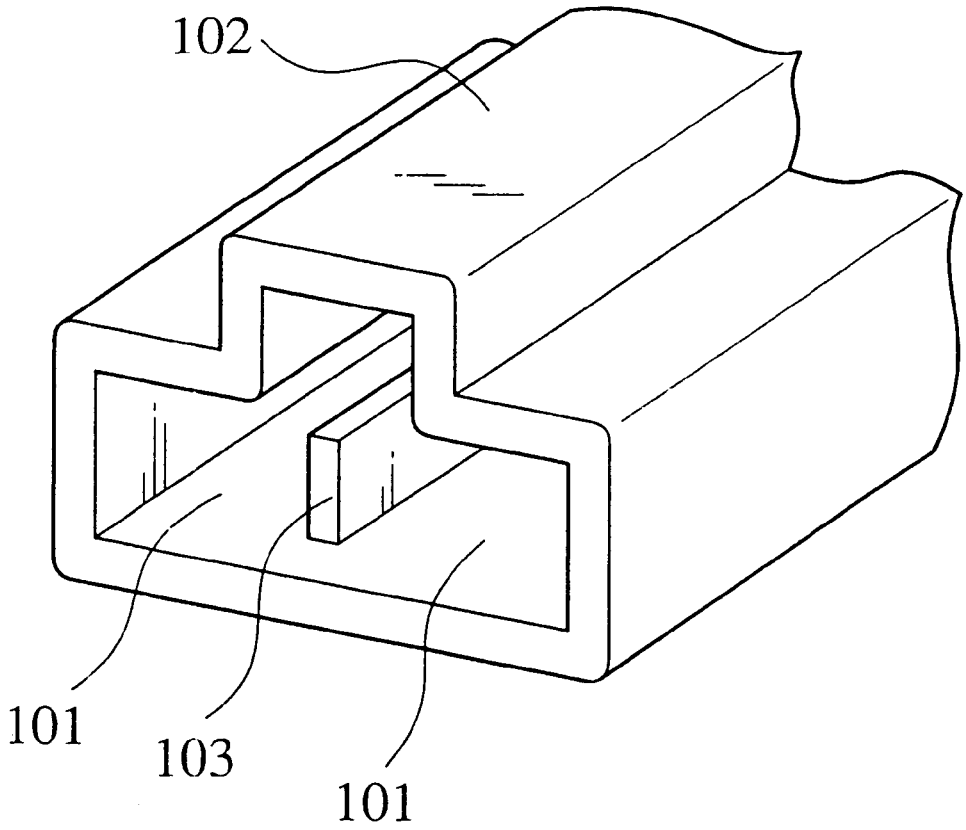
FIG.11 PRIOR ART
FIG. 11 is a perspective view of a connector housing according to a conventional coupling connector.

FIGS. 9 and 10 show a second embodiment of this invention. FIG. 9 shows a sectional view of a first connector 2 and a second connector 3 in a fitted state, and FIG. 10 shows an enlarged sectional view of the front part of a locking projection 9 and a mating recess 13 with which the projection 9 is brought into intimate contact. In FIGS. 9 and 10, structural elements like those in the first embodiment are given like numbers and are not described. Different structural elements will be described.

In the second embodiment, the mating recess 13 of a male connector housing 10 of the second connector 3 does not have a wide-spread part behind its insertion in-depth location 13*b*, but a width-narrower part 13*d*. A through hole 16 is provided in the cross direction to the width-narrower part 13*d*. The through hole 16 constitutes a locking engagement part 17. The through hole 16 reaches terminal accommodation chambers 12 of a pair of terminal cavity block parts 11. Width C of the width-narrower part 13*d* of the mating recess 13 is set smaller than the corresponding width c of a front part 7*d* of a leakage prevention wall 7 at the time of mating.

In the second embodiment, in the connector-coupled state, leakage current may pass through the surfaces of the through hole 16, the leakage prevention wall 7, and the mating recess 13 as well as the path shown in the first embodiment. The passage is longer in surface-connected distance and the front part 7*d* of the leakage prevention wall 7 and the width-narrower part 13*d* of the mating recess 13 are in intimate contact, which prevents the invasion of water.

Accordingly, the generation of leakage current including one caused by water invading into the female and male connector housings 4 and 10 can be prevented. Further, a water invasion preventing mechanism 14 is provided between the leakage prevention wall 7 and the mating recess 13 instead of fitting a packing member onto the entire internal peripheral of the terminal accommodation chambers 5 and 12 as in the conventional art, which can make a coupling connector 1 smaller.

Although in the above-described embodiments, described is the case where each of the first and second connectors 2 and 3 accommodates a pair of terminals, this invention can also be applied to the case where three or more terminals are accommodated in each connector. In that case, adjacent terminals in a female connector housing 4 are divided with leakage prevention walls 7, individual terminal cavity block parts 11 for accommodating terminals are provided in a male connector housing 10, mating recesses 13 are provided between the adjacent terminal cavity block parts 11, and water invasion preventing mechanisms 14 are provided between the leakage prevention walls 7 and the mating recesses 13, respectively.

While preferred embodiments of the present invention have been described using specific terms, such description is for illustrative purposes, and it is to be understood that changes and variations may be made without departing from the spirit or scope of the following claims.

What is claimed is:

1. A coupling connector comprising:

a first connector comprising:

a first connector housing;

a terminal accommodation chamber provided in the first connector housing for disposing a plurality of terminals therein; and at least one leakage prevention wall for dividing the terminal accommodation chamber into a plurality of divided terminal chambers for receiving the respective plurality of terminals, the leakage prevention wall forming a bulkhead between the divided terminal chambers; and a second connector comprising:

a second connector housing;

a plurality of terminal cavity block portions provided in the second connector housing for accommodating the plurality of terminals inside, each of the terminal cavity block portions being arranged to be individually inserted into the each of plurality of divided terminal chambers; and at least one mating recess provided between the plurality of the terminal cavity block portions for receiving the leakage prevention wall, wherein the leakage prevention Wall has a proximal part and a distal part, each of the parts having a thickness greater than a corresponding width of the mating recess to conform the leakage prevention wall into a contact with the mating recess at the proximal part and the distal part at the time of the mating so as to prevent water from entering the space between the leakage prevention wall and the mating recess when the first connector housing and the second connector housing are mated with each other.

2. A coupling connector as set forth in claim 1, wherein a part between the proximal part and the distal part has a smaller thickness than an insertion opening of the mating recess.

3. A coupling connector as set forth in claim 1, further comprising:

a locking projection provided at the leakage prevention wall; and a locking engagement part provided at the mating recess, wherein the locking projection is engaged with the locking engagement part at the time of mating of the connectors.

4. A coupling connector as set forth in claim 1, wherein the leakage prevention wall is spade-shaped.

5. A coupling connector as set forth in claim 1, wherein at least one of the leakage prevention wall and the mating recess is elastically deformable.

* * * * *

UNITED STATES PATENT AND TRADEMARK OFFICE

CERTIFICATE OF CORRECTION

PATENT NO. : 6,579,130 B2
DATED : June 17, 2003
INVENTOR(S) : Takaya Miwa

It is certified that error appears in the above-identified patent and that said Letters Patent is hereby corrected as shown below:

Column 8,
Line 13, "Wall" should read -- wall --.

Signed and Sealed this

Seventh Day of October, 2003

JAMES E. ROGAN
*Director of the United States Patent and Trademark Office*